United States Patent [19]

Heitman

[11] 4,068,726

[45] Jan. 17, 1978

[54] GROUND-MOVING EQUIPMENT

[76] Inventor: LeRoy Marvin Heitman, 28900 Ironwood, Sunnymead, Calif. 92388

[21] Appl. No.: 691,076

[22] Filed: May 28, 1976

[51] Int. Cl.[2] ..... E02F 3/76

[52] U.S. Cl. ..... 172/802

[58] Field of Search ..... 172/802, 801, 806, 786, 172/201; 37/41, 42 R, 50

[56] References Cited

U.S. PATENT DOCUMENTS

| | | | |
|---|---|---|---|
| 2,948,973 | 8/1960 | Magouirk | 172/802 |
| 3,061,955 | 11/1962 | Violette | 172/802 |
| 3,429,380 | 2/1969 | Launder | 172/802 |
| 3,429,381 | 2/1969 | Launder | 172/802 |
| 3,464,499 | 9/1969 | McKell | 172/802 |
| 3,861,475 | 1/1975 | Kuncewicz | 172/71 |

FOREIGN PATENT DOCUMENTS

| | | | |
|---|---|---|---|
| 1,525,951 | 4/1968 | France | 172/802 |

*Primary Examiner*—Richard J. Johnson
*Attorney, Agent, or Firm*—Harvey C. Nienow

[57] ABSTRACT

Ground-moving equipment comprising an arcuate main blade to be fixed to suitable motive power means such as a bulldozer or the like, and an elongated auxiliary blade hingedly connected to said main blade and operable for forming or cleaning a slope which extends upwardly or downwardly from the position of the bulldozer. More specifically, it comprises a pivotal connection between the auxiliary and main blades, and a hydraulic actuator also connected between such blades and operable to enable the relative positions of such blades to be changed from a remote location.

4 Claims, 5 Drawing Figures

FIG. 1
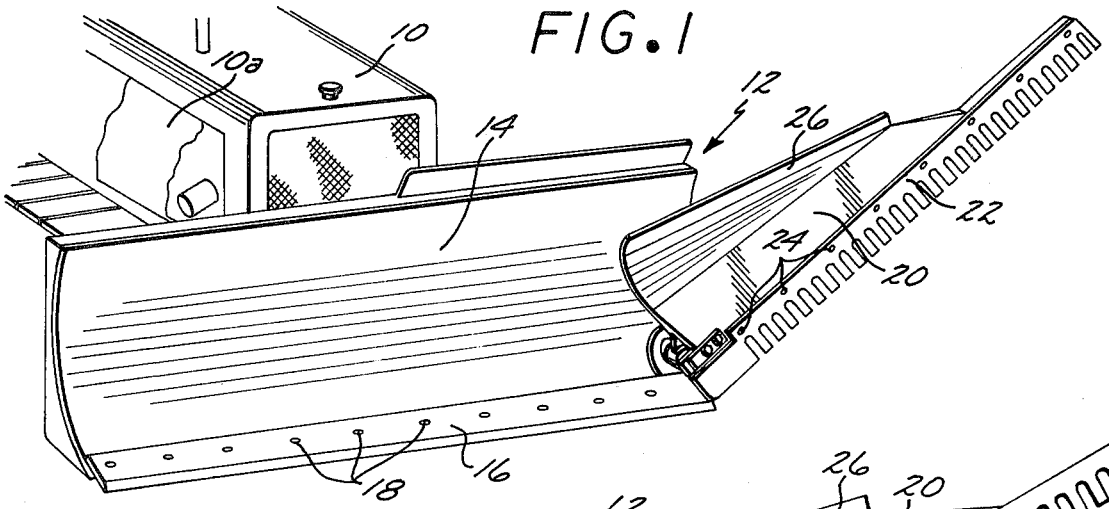
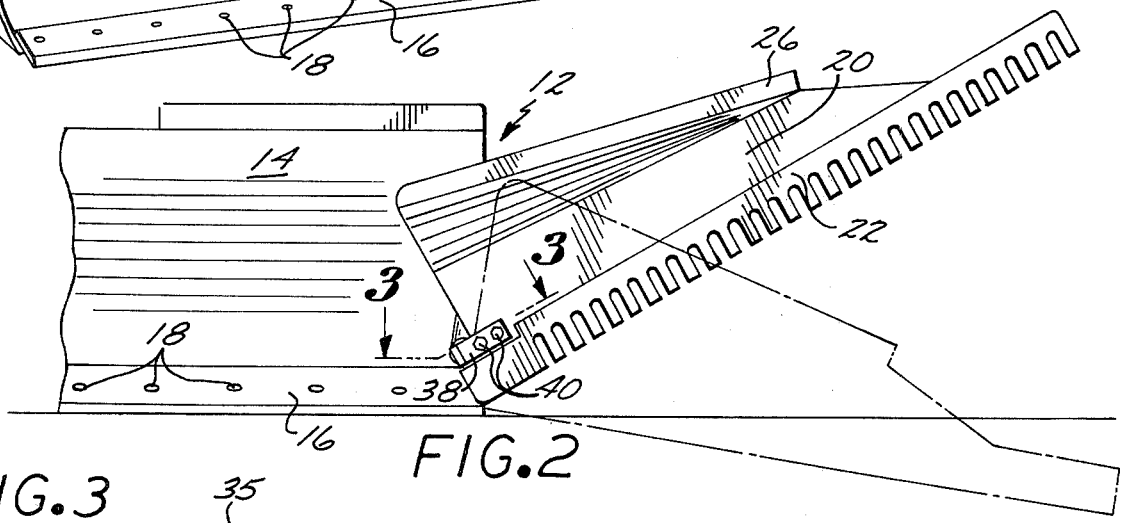
FIG. 2
FIG. 3
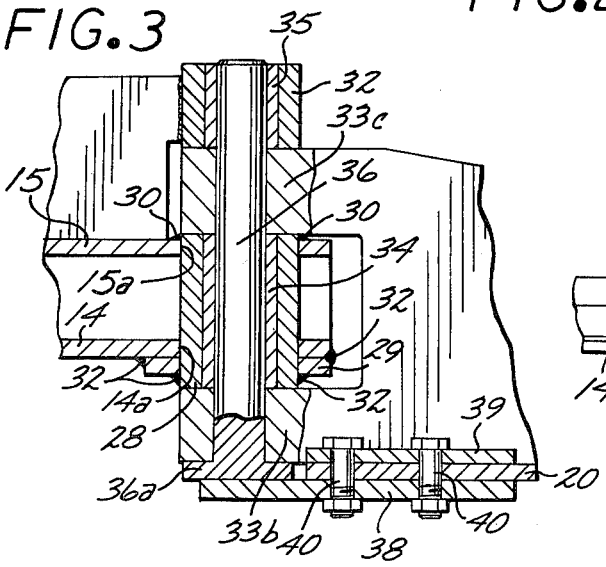
FIG. 4
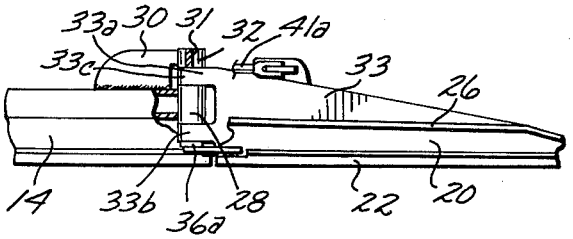
FIG. 5
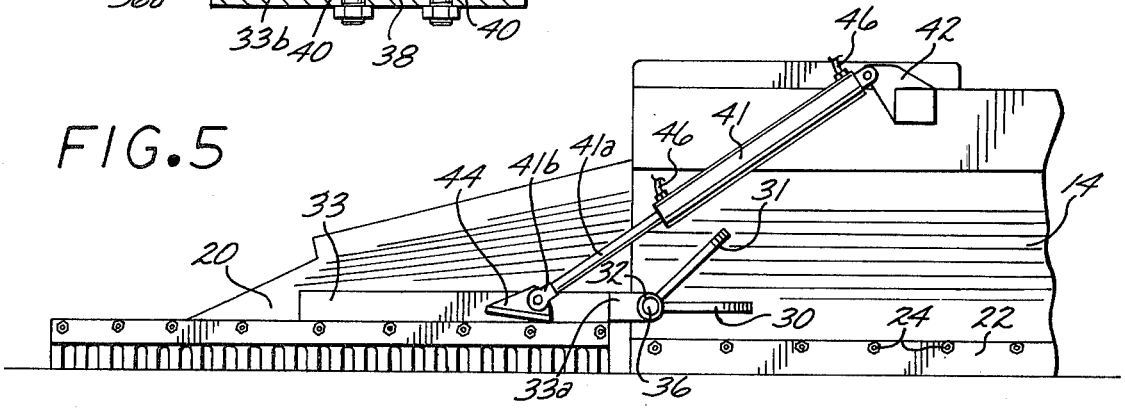

GROUND-MOVING EQUIPMENT

The present invention relates generally to ground-moving equipment, and more particularly to equipment for quickly and easily shaping or forming slopes.

In the grading of hillside lots or sites for buildings, it is necessary to shape or maintain the hillside at a certain slope so as to insure optimum appearance and to afford adequate drainage of surface water. Since bulldozer equipment and the like is usually readily available at such building sites, it is desirable to utilize such power equipment to accomplish the necessary grading operation.

It is an object of the present invention to provide ground-moving equipment which can be attached to a bulldozer and which is operable from a relatively level position of the bulldozer to cut or clean a slope.

A further object of the present invention is to provide ground-moving equipment as characterized above which comprises a main blade to be fixed to the bulldozer and an auxiliary blade which can be angularly positioned as desired, either above or below the horizontal.

An even further object of the present invention is to provide ground-moving equipment as characterized above which employs actuation means and remote controls therefor for altering or varying the position of the auxiliary blade.

A still further object of the present invention is to provide ground-moving equipment as characterized above which is simple and inexpensive to manufacture, and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a perspective view of a bulldozer provided with ground-moving equipment according to the present invention;

FIG. 2 is a fragmentary elevational view of the ground-moving equipment of FIG. 1;

FIG. 3 is a fragmentary sectional view taken substantially along line 3—3 of FIG. 2 of the drawings;

FIG. 4 is a fragmentary top plan view of the ground-moving equipment; and

FIG. 5 is a fragmentary rear elevational view of the ground-moving equipment of FIG. 1.

Like reference characters indicate corresponding parts throughout the several views of the drawings.

Referring to FIG. 1 of the drawings, there is shown therein a bulldozer 10 which may take substantially any desired form, but is shown as comprising an engine 10*a* as a source of power for tracks 10*b*.

Attached to the front of the bulldozer is the ground-moving equipment 12 which includes a main blade 14 attached to the bulldozer by any appropriate means. Blade 14 is afforded three directions of movement relative to the bulldozer, namely to be raised or lowered, to be tilted back or forward, and to be angled forward or backward with either the right or left edge. The main blade 14 is formed with a generally arcuate shape and, along its lower edge is provided with a ground-cutting edge member 16. Member 16 is secured to main blade 14 in any appropriate manner as by the use of rivets or bolts 18.

Main blade 14, as well as edge member 16, is preferably formed of extremely high wear-resistant steel so that the blade can quickly and easily cut large quantities of earth or ground for extended periods of time.

Attached to main blade 14 is auxiliary blade 20 which is generally triangular in shape and construction. The lower edge of the auxiliary blade 20 is provided with a cutting edge member 22 which is fastened to blade 20 by rivets or bolts 24.

To prevent the earth from going over the top of blade 20, as will hereinafter become more apparent, a plate 26 is secured to the upper edge of blade 20 as by welding, brazing, soldering or the like. Such plate 26 is operable to direct the ground either into the main blade 14 or beyond the end of the auxiliary blade 20.

As shown most particularly in FIG. 3 of the drawings, auxiliary blade 20 is pivotally mounted on main blade 14. Aligned through openings 14*a* and 15*a* are formed in the main blade 14 and its reinforcing plate 15. Firmly secured within such openings is a sleeve member 28 which may be a section of pipe or the like. Such sleeve member is firmly secured to the main blade 14 and reinforcing plate 15 as by welding, and a reinforcing plate 29 is welded to the main blade 14 about the opening 14*a* therein. The sleeve 28 is firmly secured to such reinforcing plate 29 as by welding or the like.

As shown most particularly in FIGS. 3 and 5 of the drawings, a pair of reinforcing gussets or supports 30 and 31 are welded to the back of reinforcing plate 15. A sleeve 32 is carried by such gussets, and is welded thereto as shown most particularly in FIG. 3 of the drawings.

An elongated mounting member 33, as shown most particularly in FIG. 4, is firmly secured to the back of auxiliary blade 20. One end 33*a* of member 33 is bifurcated to provide extensions 33*b* and 33*c* which, as shown most paricularly in FIG. 3 of the drawings, are formed with aligned through openings.

A pair of bronze wear bushings 34 and 35 are suitably positioned within the sleeves 28 and 32, respectively, and, with the extensions 33*b* and 33*c* on either side of sleeve 28, a fastening pin 36 is positioned as shown in FIG. 3. Pin 36 is formed with a head 36*a* which abuts against the extension 33*b* of mounting member 33. A hold-down device is then firmly secured to the blade 20 by means of plates 38 and 39 and fastening bolts 40.

To actuate the auxiliary blade to any position between its uppermost position and its lowermost position, a hydraulic actuator 41 is provided. The uppermost position approximates the vertical position of blade 20 wherein the cutting edge member 22 is at substantially right angles to the cutting edge member 16 of main blade 14. The lowermost position of auxiliary blade 20 on main blade 14 places the cutting edge member 22 approximately 30° below the horizontal; making the included angle between the member 16 and member 22 approximately 120°.

The hydraulic actuator 41 is pivotally secured to a bracket 42 which is welded to the main blade 14. The piston rod 41*a* of actuator 41 has one end 41*b* pivotally secured to a tab 44 which is welded to the mounting member 33 on blade 20. Suitable hydraulic lines 46 extend from the actuator 41 to remotely located control means (not shown), preferably near the operator's station for operating the bulldozer 10.

The size of the actuator 41 selected as well as the position of attachment thereof to both main blade 14 and auxiliary blade 22 are selected to afford the above-noted 120° range of positions for blade 20 on main blade 14.

Thus, by suitable manipulation of the controls by the operator of the bulldozer, the hydraulic actuator 41 can be extended or contracted as desired. This causes the auxiliary blade 20 to be pivoted on the main blade within the sleeves 28 and 32 to the desired position.

It is thus seen that the present invention provides ground-moving equipment for a threeway movable blade bulldozer which includes an auxiliary blade which can be positioned so as to shape or cut an upward or downward extending slope while the bulldozer moves along a horizontal path.

Although I have shown and described certain specific embodiments of my invention, I am well aware that many modifications thereof are possible. The appended claims are not to be restricted except insofar as is necessitated by the prior art.

I claim:

1. Ground-moving equipment for attachment to suitable motive power means comprising in combination, an arcuate main blade having a ground-cutting edge and adapted with fastening means for attachment to said motive power means in a substantially horizontal position to be raised and lowered, and to be angled in the horizontal and vertical planes as desired, an elongated auxiliary blade having a ground-cutting edge, and means including hinge means connected to said auxiliary and main blades and a hydraulic actuator comprising remote control means and a source of hydraulic power, said actuator being connected to said main and auxiliary blades at such locations that said ground-cutting edge of said auxiliary blade can be positioned below and above the horizontal position of said main blade, said hinge means constituting the sole support for said auxiliary blade against movement in a horizontal plane comprising a pair of sleeves fixed in spaced relation to said main blade and having individual ware bushings and a bifurcated mounting member on said auxiliary blade having a pair of spaced extensions straddling one of said sleeves, and a pivot pin positioned in aligned openings in said wear bushings and extensions to prevent movement other than rotational movement between said blades.

2. Ground-moving equipment for attachment to suitable motive power means according to claim 1, wherein retaining means is provided for retaining said pin in said sleeves and extensions of said bifurcated mounting member.

3. Ground-moving equipment for attachment to suitable motive power means according to claim 2, wherein said pin is formed with a head and said retaining means comprises a plate secured to said auxiliary blade against the head of said pin.

4. Ground-moving equipment for attachment to suitable motive power means according to claim 3, wherein said extensions of said mounting member of said auxiliary blade are spaced to closely and firmly straddle said one of said sleeves, said retaining means securing said pin relative to said extensions to cause rotation between said blades to wear said bushings.

* * * * *